US005148631A

United States Patent [19]

Bayard et al.

[11] Patent Number: 5,148,631

[45] Date of Patent: Sep. 22, 1992

[54] PNEUMATIC DOOR OPERATOR HAVING PNEUMATIC ACTUATOR AND LOCK

[75] Inventors: Robert G. Bayard, St. Eustache; Anthony J. Walsh, Lachine, both of Canada; Roger J. Weseloh, Mount Prospect, Ill.

[73] Assignee: Mark IV Transportation Products Corporation, Chicago, Ill.

[21] Appl. No.: 447,793

[22] Filed: Dec. 8, 1989

Related U.S. Application Data

[63] Continuation-in-part of Ser. No. 167,221, Mar. 11, 1988, Pat. No. 4,901,474.

[51] Int. Cl.[5] ..... E05D 13/04

[52] U.S. Cl. ..... 49/449; 49/370

[58] Field of Search ..... 49/26, 370, 449; 292/DIG. 65, DIG. 21, 201

[56] References Cited

U.S. PATENT DOCUMENTS 4,142,326 3/1979 Schmitz .
4,198,786 4/1980 Monot .
4,872,286 10/1989 Peirish et al. .
4,901,474 2/1990 Bayard et al.. .
4,912,878 4/1990 Bentley .

FOREIGN PATENT DOCUMENTS 1452180 9/1966 France ..... 49/449

*Primary Examiner*—Gerald A. Anderson
*Attorney, Agent, or Firm*—Francis J. Lidd

[57] ABSTRACT

A power door operator for transit vehicles utilizing a rodless pneumatic cylinder as a prime mover in opening and closing doors in the sidewall of a transit vehicles. Door movement having a controlled, predetermined door edge force is achieved through mechanical coupling an external piston of the rodless cylinder and vehicle doors through and endless toothed belt. Magnetic coupling between internal and external pistons of the cylinder provide controlled force having a maximum or breakaway value applied to the operated door. A novel reaction lock operated by admission of pressurized air to the cylinder latches or unlatches the operated door in its closed position subsequent or prior to door closing or opening. Control of door motion at the ends of its travel is achieved through the use of a novel differential area internal piston in the pneumatic cylinder. Available internal piston force is modified for predetermined piston positions on approaching either end of the cylinder through the use of a sliding rod contained by the pressure sensitive internal position. Movement of the sliding rod adjust the effective piston area so as to modify available force to controlling door motion. An additional embodiment of the invention disclosed utilizes direct panel locking means independent of the operator drive belt.

3 Claims, 15 Drawing Sheets

PNEUMATIC DOOR OPERATOR HAVING PNEUMATIC ACTUATOR AND LOCK

CROSS REFERENCE TO RELATED APPLICATIONS

This application is a continuation-in-part of application Ser. No. 167,221, filed on Mar. 11, 1988, now U.S. Pat. No. 4,901,474.

BACKGROUND OF THE INVENTION

This inventions relates generally to automatic power door operators and more particularly concerns a pneumatic power door operator suitable for positioning overhead of the driven door when used on a mass transit vehicle.

Pneumatic door operators have been utilized for a substantial period of time to open and close vehicular doors. Typically such operators employ long stroke pneumatic cylinders of conventional design, or pneumatic differential engines wherein rectilinear motion is converted to rotary motion through the use of rack and pinion gearing. Operators utilizing the long stroke piston require longitudinal overhead space approximately equal to twice the stroke or actuating movement of the cylinder. In operators using the differential engine, the relatively small rotary travel of the rack and pinion requires an extensive array of operating levers and/or force multiplying links in order to adequately operate a given door. Examples of these operators are contained in U.S. Pat. Nos. 3,858,920, 3,916,567, 2,866,442 and 2,343,316.

Recent mass transit vehicles are of streamlined design requiring construction methods which greatly reduce the available intra-structure spaces formerly utilized to house the operator. Reduced available space often does not permit installation of actuating and/or operating rods, cables, and/or other force transmitting devices.

The invention disclosed herein overcomes essentially all of the above discussed spatial limitations through the use of a rodless cylinder, thereby greatly reducing door overhead longitudinal space required for housing the operator. Rodless cylinder designs minimize longitudinal space to essentially that of the basic cylinder itself. A rodless cylinder similar to the type utilized in this invention is disclosed and claimed in U.S. Pat. No. 3,779,401 said patent hereby incorporated by reference.

A further shortcoming of presently used pneumatic power door operators for transit vehicles arises from the requirement that vehicular doors be locked to prevent unauthorized exit or entry and safe operation of the car when in motion. In the case of the aforementioned pneumatic operators of the long stroke cylinder or differential engine type, door locking is sometimes achieved through "holding" pressure in the opposite side of a cylinder during vehicular operation. As those skilled in the design and operation of transit vehicles will readily recognize, loss of pneumatic pressure with "pressure hold" operation can result in freewheeling doors and passenger hazards attendant thereto. Therefore, recent door equipment has for the most part required positive mechanical locks which do not depend on operating air pressure for maintaining the operated doors in a closed position.

The invention disclosed herein provides a novel and highly satisfactory mechanical lock of simple construction which can be actuated or deactuated by the actuating pneumatic cylinder through the application of fluid pressure to the cylinder and/or mechanically released in the case of loss of pressure and/or emergency situations.

An additional feature of the invention disclosed is the controlled force applied from the cylinder external piston to the operated door. Rodless cylinders utilize magnetic field coupling between a pneumatic piston internal of the cylinder and a magnetically coupled piston external of the cylinder. The maximum force exerted on the external piston by movement of the internal piston is termed "breakaway" force. The breakaway force is controlled to limit force applied to the operated door through mechanical coupling of the door and external piston. This construction minimizes applied door edge force allowing breakaway of the door when door movement is resisted due to objects or passengers in the door path, known as door obstructions.

Accordingly, it is an object of this invention to provide a novel pneumatic power door operator requiring a minimum of longitudinal space overhead of the operated door.

It is an additional object of this invention to provide a pneumatic power door operator wherein the longitudinal space required is limited to essentially the movement of the operated door.

It is yet further an object of this invention to provide a pneumatic power door operator wherein a positive mechanical lock is achieved through utilization of the power cylinder reaction forces.

It is a still further object of this invention to provide a pneumatic door operator having a positive mechanical lock operable by the primary actuating gear.

It is a further object of this invention to provide a pneumatic power door operator wherein cushioning of door travel is provided through controlled escape of operating air, and change in effective piston area.

It is another object of the invention to provide a power door operator for a passenger mass transit vehicle having controlled door edge force in closing due to limiting operator breakaway force.

It is further object of the invention to provide a vehicular power door operator wherein door motion and control is reestablished after breakaway by re-cycling the actuating piston in the cylinder.

SUMMARY OF THE INVENTION

In accordance with the invention disclosed and claimed here, a transit vehicle door opening is selectively closed and opened by a door or doors moving along a horizontal toothed belt. Belt drive is achieved through attachment to the external piston of a rodless pneumatic cylinder having an internal pressure sensitive piston magnetically coupled to the exterior piston. The actuating cylinder is mounted so as to have a limited amount of controlled lateral motion, utilized to operate a novel mechanical lock.

Internal and external pistons are coupled through magnetic attraction between the internal fluid actuated piston, and a radially adjacent external piston. With this construction, the external piston follows the internal piston movement due to inter-piston magnetically coupled force. However, magnetic coupling forces are controlled and when door operating force required exceeds a predetermined or breakaway valve, internal and external pistons become uncoupled, allowing free movement of the door recycling or the internal piston allows recoupling.

Controlled breakaway force is advantageous in preventing excessive door edge force when unexpected objects in the door travel path obstruct door movement. Door breakaway allows the obstruction to be removed followed by re-coupling to complete door motion.

In emergency situations, closed and locked doors can be opened by exceeding the "breakaway" value.

In order to properly cushion the external cylinder stroke and minimize impact shocks between the moving door and its end of travel stops, a novel internal, i.e., pressure sensitive piston having an internal rod for controlling at first the operative exit air from the cylinder in the direction of piston travel, and a further controlled reduction in effective piston area as the piston approaches the end of its stroke.

This construction substantially reduces the energy absorption necessary when a rapidly moving transit door is decelerated to stop either in the open and/or closed position.

In operation, the external piston portion of the aforementioned rodless cylinder drives a toothed belt coupled to horizontal cooperating pulleys mounted at either end of the door opening. The driven door or doors is appropriately attached to an adjacent portion of the toothed drive belt, resulting in door movement equivalent to the operating length of the cylinder. In the case of bi-parting double doors, an additional bracket attached to the opposite side of the belt provides reversed door movement of the second door.

Positive mechanical locking of the doors achieved through releaseably latching an adjacent portion of the belt to the car body frame. Release of the latch is accomplished through controlled lateral motion of the entire cylinder assembly in the direction opposite to the door opening motion of the external cylinder.

Release operation of the lock occurs due to the reaction forces on the cylinder when pressurized air is admitted so as to drive the external cylinder in the opening direction. On entry of the actuating air, an initial and controlled motion due to door frictional and inertial resistance to motion operates to unlatch the door whereupon the cylinder is retained in the reaction position as the external cylinder moves in the opposite direction to complete door opening.

Door closing proceeds with air applied to the opposite side of the cylinder, moving the external cylinder in the opposite or closing direction. As the cylinder is moved to the reaction position the novel latch approaches its mating hook, the latch is moved to a raised position by a wedge carried on the cylinder end, a position immediately above the aforesaid hook. In this location or position, a reduction in cylinder pressure allows the cylinder to return to its prior longitudinal or unpowered position, thereby dropping the latch on to its mating hook. The latch and hook achieve a positive mechanical lock of the operating belt and attendant locking of the operated doors.

Cushioning of the internal pneumatic piston and door motion at the end of either opening or closing movement of the internal operating piston is accomplished through the use of a motion sensitive pressure sealed rod centrally located in the internal piston. Each end of the rod carries a seal which cooperates with a mating seal contained in each end of the cylinder.

In operation as the piston and rod assembly approach either end of the cylinder, the mating seal and rod assembly act to close off a first centrally located cylinder exhaust port. This forces air to exit through a substantially smaller second port thereby reducing piston speed. The pneumatic seal effected between the cylinder and seal rod end further acts to reduce the pressure effective piston area in the direction of motion so that in addition to the orifice damping attained from the smaller relief port, a further reduction of piston speed is controllably achieved through proper selection of the rod diameters. Those skilled in the pneumatic art, will readily understand that the inclusion of a centrally located rod operable at a predetermined location of the piston results in a reduction in piston operating force through area reduction. Exposing a portion of the piston pressure sensitive area to external operating fluid pressure lower than that internal of the cylinder reduces the pressure sensitive piston area exposed to cylinder internal pressure. Action of the piston and central rod, rod end seals, and exhaust port seats establish a differential area piston wherein portions of the piston pressure sensitive area are exposed to and acted on by different fluid pressures.

BRIEF DESCRIPTION OF THE DRAWINGS

Other objects and advantages of the invention disclosed herein will become apparent upon reading the following detailed description and accompanying reference to the drawings in which.

DETAILED DESCRIPTION OF THE INVENTION

Figure 1:
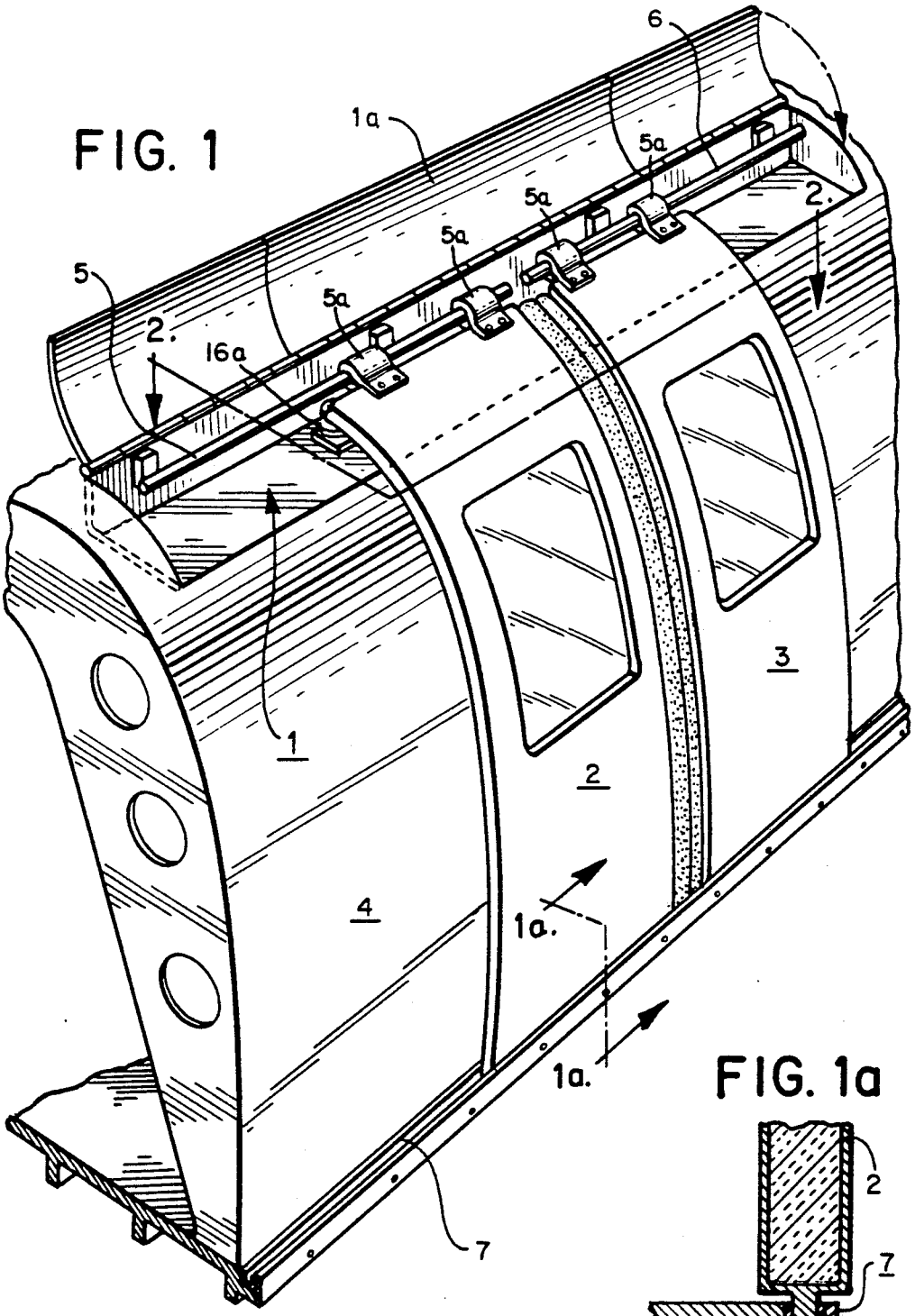
FIG. 1 is a partial tear-away section of a typical sliding plug door of the type employing two bi-parting concave doors formed to match the convex outer surface of the vehicle.
Figure 1A:
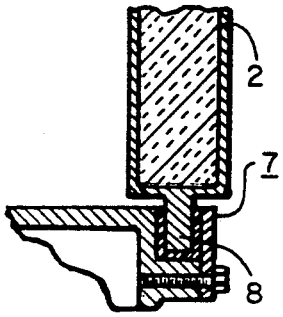
FIG. 1*a* is a detailed section particularly showing the lower door guide and support along Section 1*a*—1*a*.

With initial reference to FIG. 1, there is shown a preferred embodiment of the invention disclosed herein including a door operator and hanger assembly (1) operating concave sliding doors (2) and (3) for opening and closing an aperture in the wall (4) of a transit car. The door assemblies (2) and (3) are supported at their upper end by a door support rod (5) for the left hand door and an identical door support rod (6) for guiding the right hand door (3). Sliding doors (2) and (3) are supported and guided at their lower edge by a car floor or lower edge guide rail (7). As shown in accompanying FIG. 1*a*, the lower edge of either door (2) or (3) has a projection (8) which is partially contained in a carbody guide rail (7) for guiding door through lateral motion along the surface of the carbody (4). Anti-friction material (9) is interposed between the door projection or tongue (8) or guard rail (7).

Control of upper door movement is provided by upper door guide or hanger (5*a*). As best seen in accompanying FIGS. (4*a*) and (4*b*) the upper door hangers (5*a*) are equipped at the interface between hanger and door support rods with anti-friction devices, typically a linear ball bushing. Those skilled in the art will readily understand that other types of anti-friction interface can be used as well.

Figure 5:
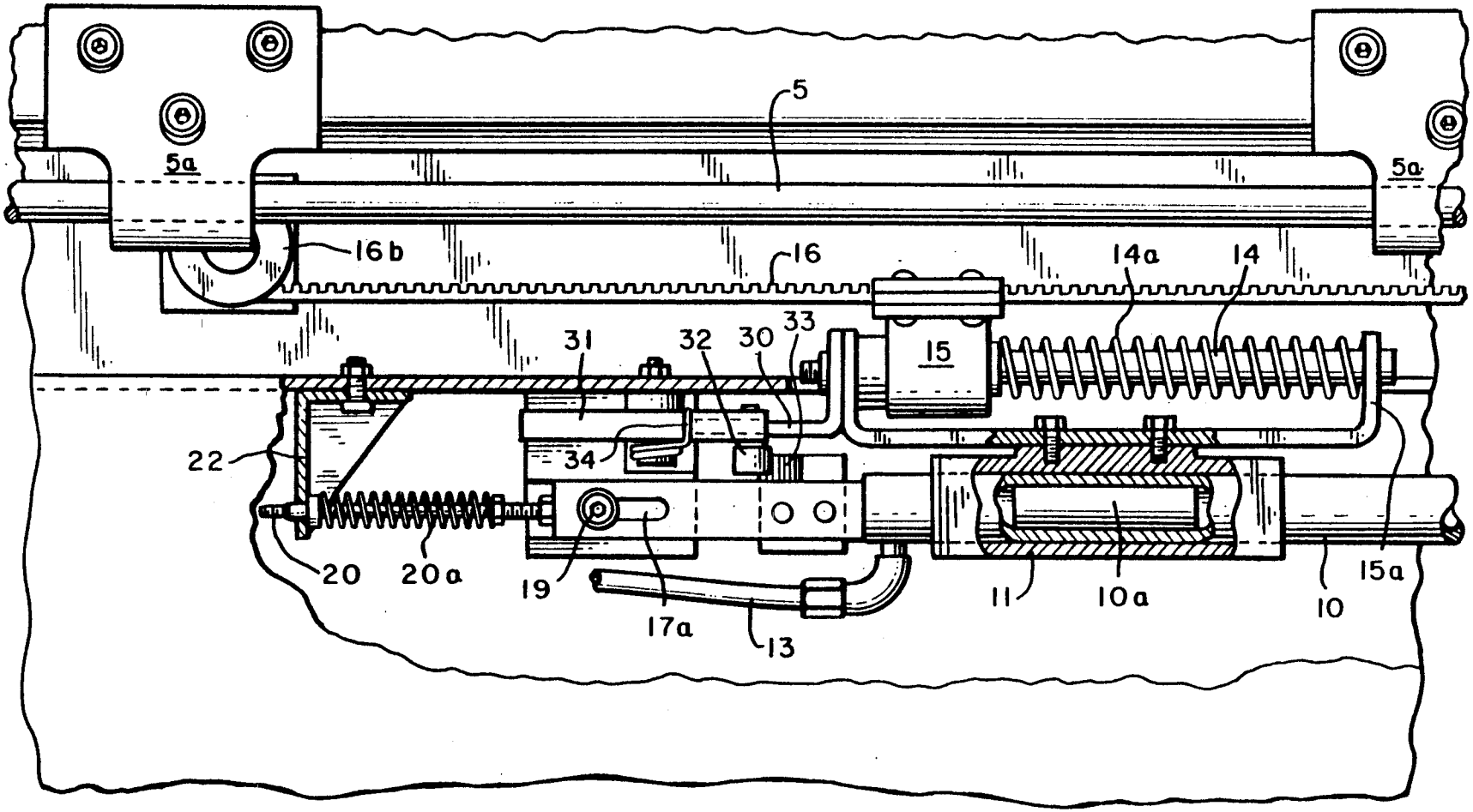
FIG. 5 is a further partial plan view of the right hand door member, particularly showing right-hand the lost motion link, reaction force spring, and door push back or door overtravel spring.
Figure 10:
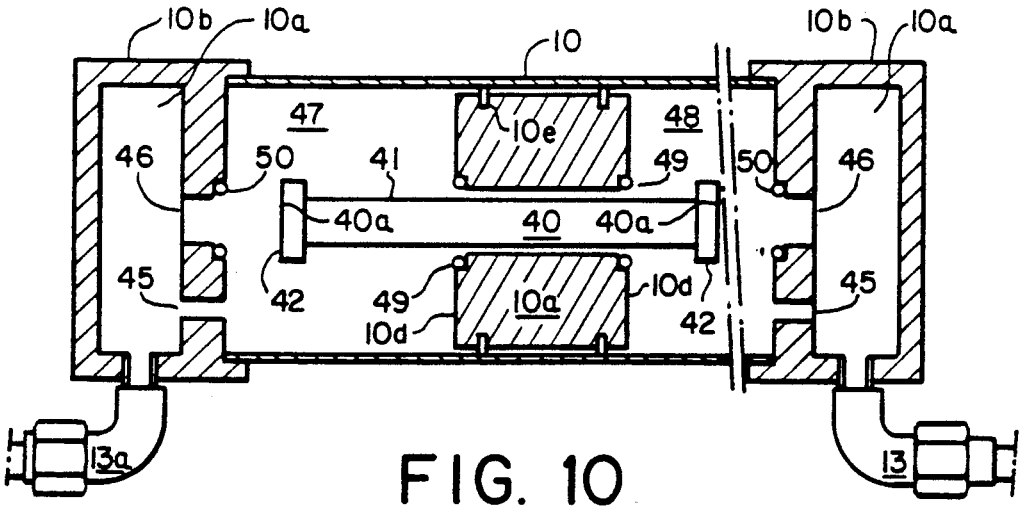
FIG. 10 is a sectional view of the rodless cylinder of the invention without the external piston particularly showing the piston cushioning rod, inlet and outlet ports and piston operating air supply conduits and fittings.

Sliding or bi-parting movement of the doors (2) and (3) is achieved through use of the invention disclosed herein consisting of a rodless pneumatic cylinder (10) having an internal sliding pressure sensitive piston (10*a*) reference FIGS. 5, and 10. An external or operating piston (11) is magnetically coupled to the internal piston (10*a*) providing controlled force for linear travel of the external piston (11) along the outer periphery of the piston (10) when air pressure is introduced the cylinder (11) on either side of the piston (10*a*). Typically air is introduced at either end of the cylinder via conduits (13) and (13*a*). Returning to FIGS. 2 and 5, attached to the external piston (11) is a door force bracket assembly (12) incorporating a lost motion or push back feature providing relative motion between door panels and the drive belt (16) and external piston (11). Spring (14*a*) controls force exerted on door panels by piston (11). The push back feature consists of a rod (14) surrounded by a compression spring (14*a*) abutting a cog belt adapter (15) for force transmittal to the door operating cog belt (16). The adapter (15) encircles the rod (14) and is contained between one end of the limited force push back spring (14*a*) and a U-shaped door force assembly bracket (15*a*).

Figure 2:
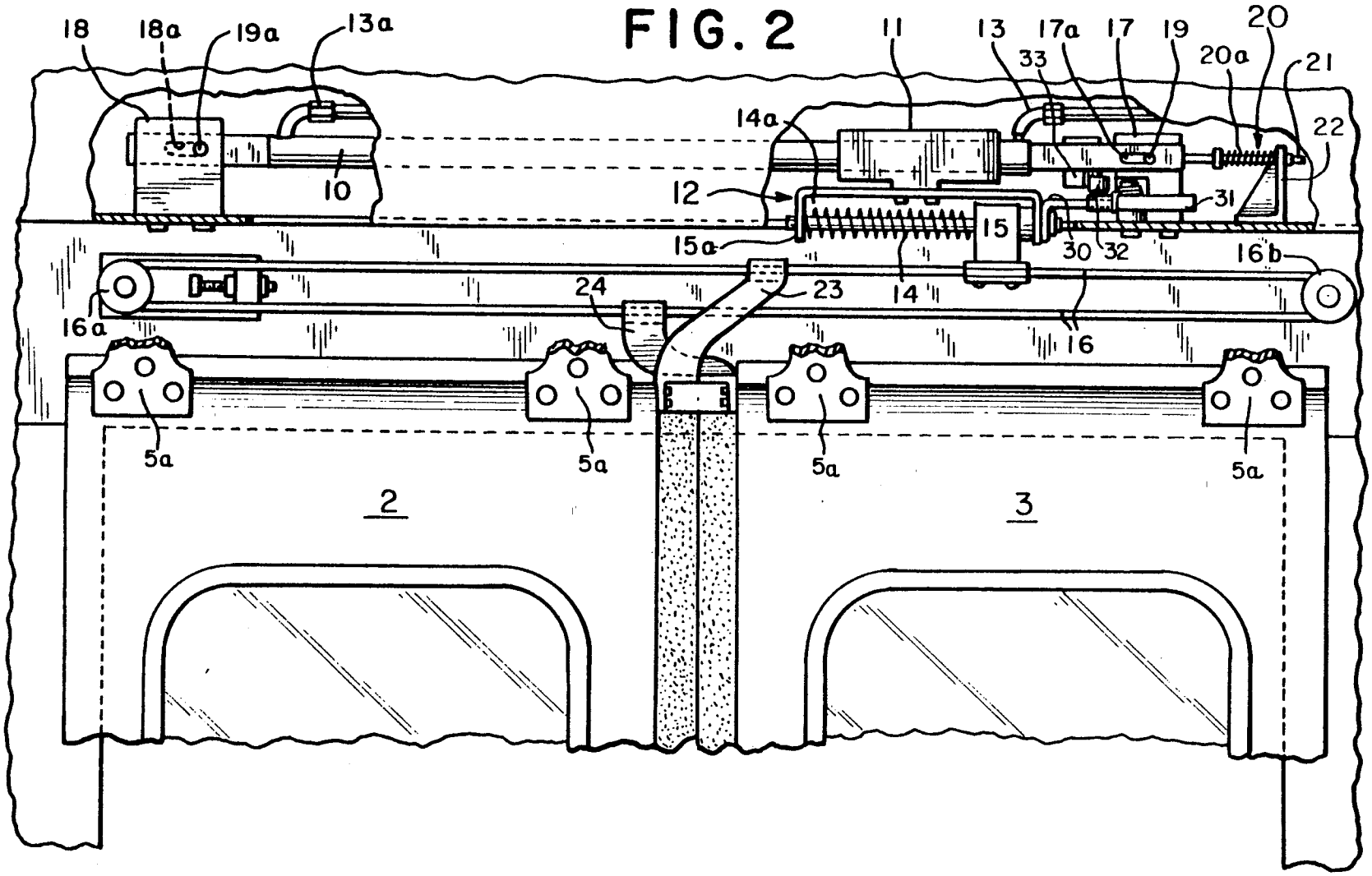
FIG. 2 is a partial tear-away plan view of the actuator located overhead of the vehicular door opening, particularly showing the location of door actuating levers attached to the driven toothed belt, and push-back attachment to the operator external piston.
Figure 3A:
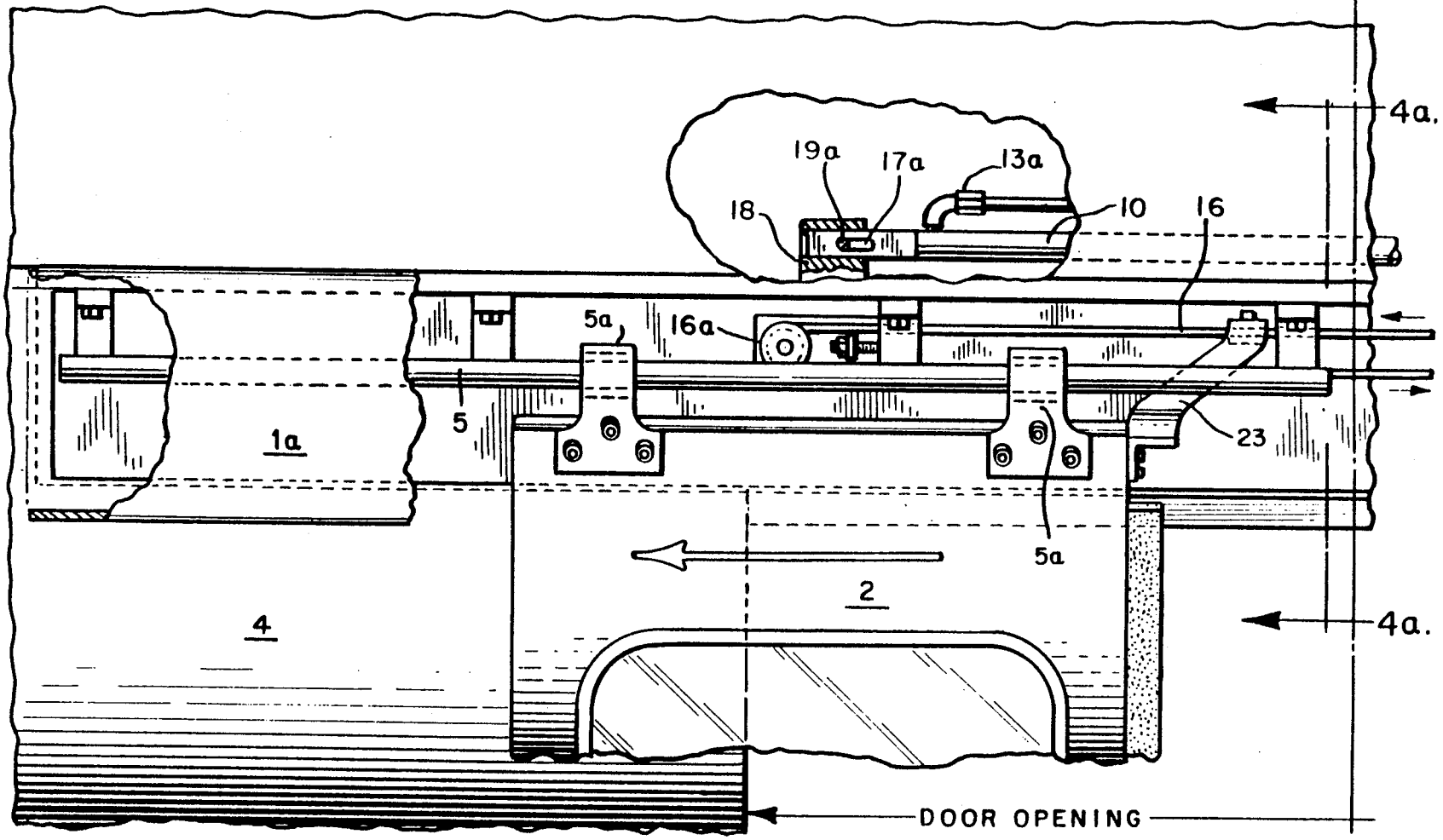
FIG. 3*a* is an additional partial tear-away view of the left hand door in a partially open position particularly showing the left hand lost motion mounting link of the actuating cylinder, and upper door support rods.
Figure 3B:
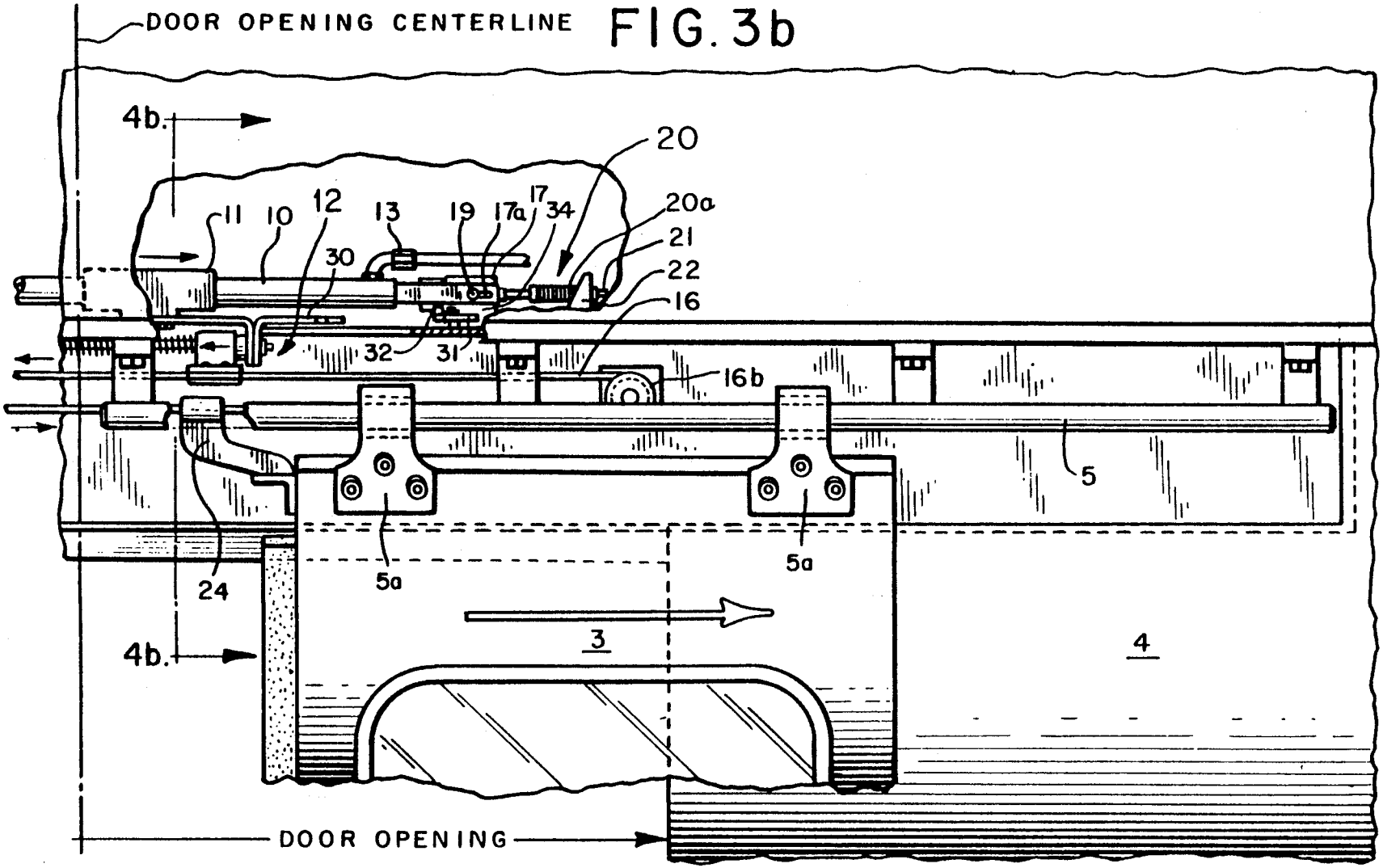
FIG. 3*b* is an additional partial tear-away view of the right hand driven door particularly showing right-hand the lost motion link and reaction force spring attached to the car frame.
Figure 4A:
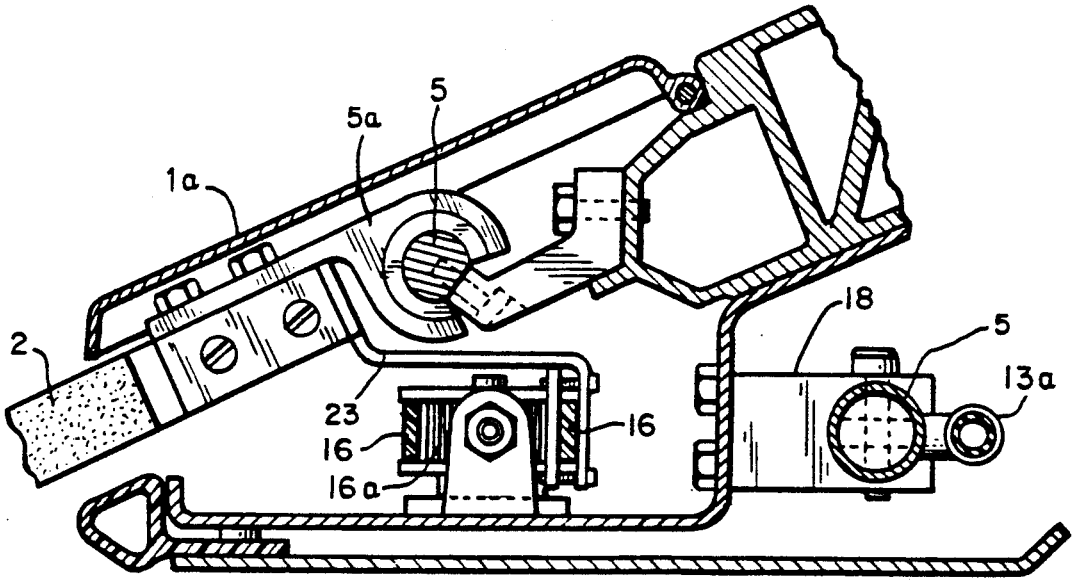
FIGS. 4*a* and 4*b* are detailed section through the left hand and right hand doors particularly showing the utilization and location of the toothed belt pulleys, the upper door rod supports and hinged cover.
Figure 4B:
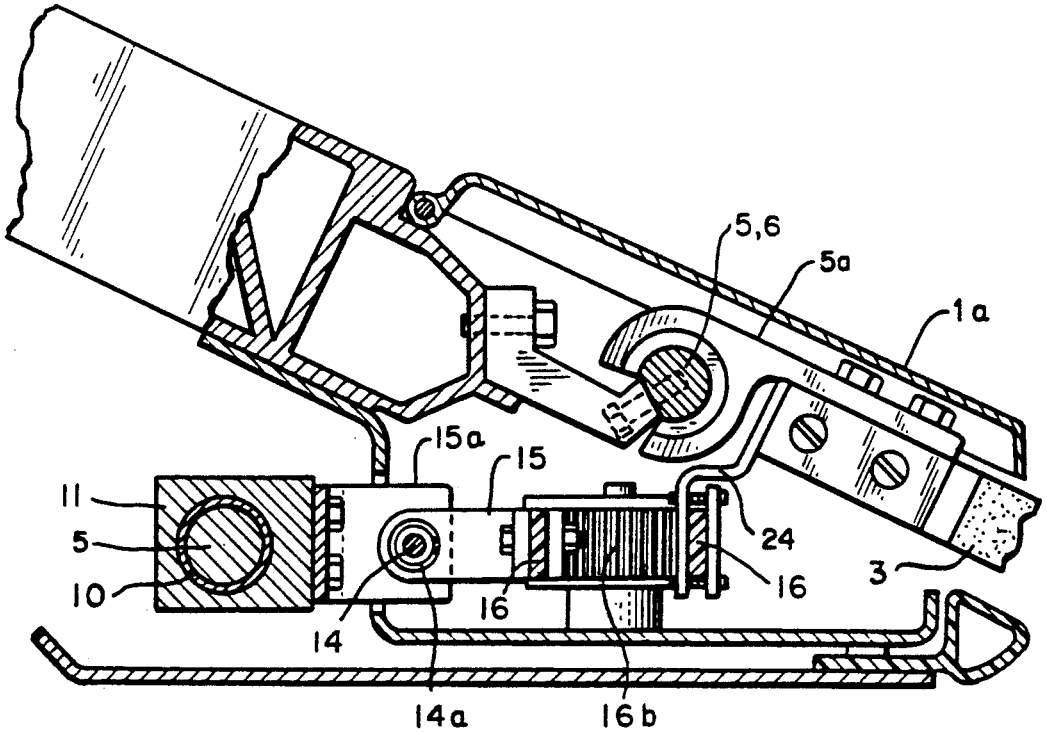

As shown in FIGS. 2, 3*a*, and 3*b*, a toothed or cogged drive belt (16) is suspended between operating pulleys (16*a*) and (16*b*) mounted on the base of the operator disclosed and adjacent each end of the car door opening. Attached to opposite sides of the belt (16) are door operating brackets or arms (23) and (24). As best shown in FIGS. 4*a* and 4*b*, the operating brackets are arranged to operate the left and right hand doors (2) and (3) from opposite sides the belt (16).

The power cylinder (10) is mounted above the car door opening space internal of the car body and is supported at either end by support brackets (17) and (18). Each end of the power cylinder is attached to its mounting bracket through lost motion slots (17*a*) and (18*a*) cooperating with retaining pins (19) and (19*a*). Extending from the right hand end of the power cylinder (10) is a lost motion force assembly (20) having a rod (21) with one end attached to its opposite end the cylinder end (23), and movably projecting through mounting bracket (22). The bracket (22) is fixed to the power door actuator base or other suitable portion of the door assembly structure. The reaction lock spring (20*a*) surrounds a major portion of the rod (21) and is retained between the right hand cylinder end (23) and the inner face of the bracket (22). The projecting end of the rod (21) is threaded to permit adjustment of the compressed length of the spring (23) providing control of the cylinder reaction force applied to the cylinder (10) as it traverses the slots (17*a*), and (18*a*) during operation of the reaction lock and unlock.

Projecting from the right hand end of the U-shaped door force bracket (15*a*) is a door lock hook (30). With particular reference to FIGS. 6, 8*a*, 8*b*, 8*c*, 9 and 9*a*, a door lock hook cooperates with additional portions of a novel door lock disclosed herein which will be discussed in greater detail below.

Power cylinder motion due to cylinder force reaction as described above and the door locking feature are a major portion of the invention disclosed herein and will be further discussed in substantial detail below.

Figure 13:
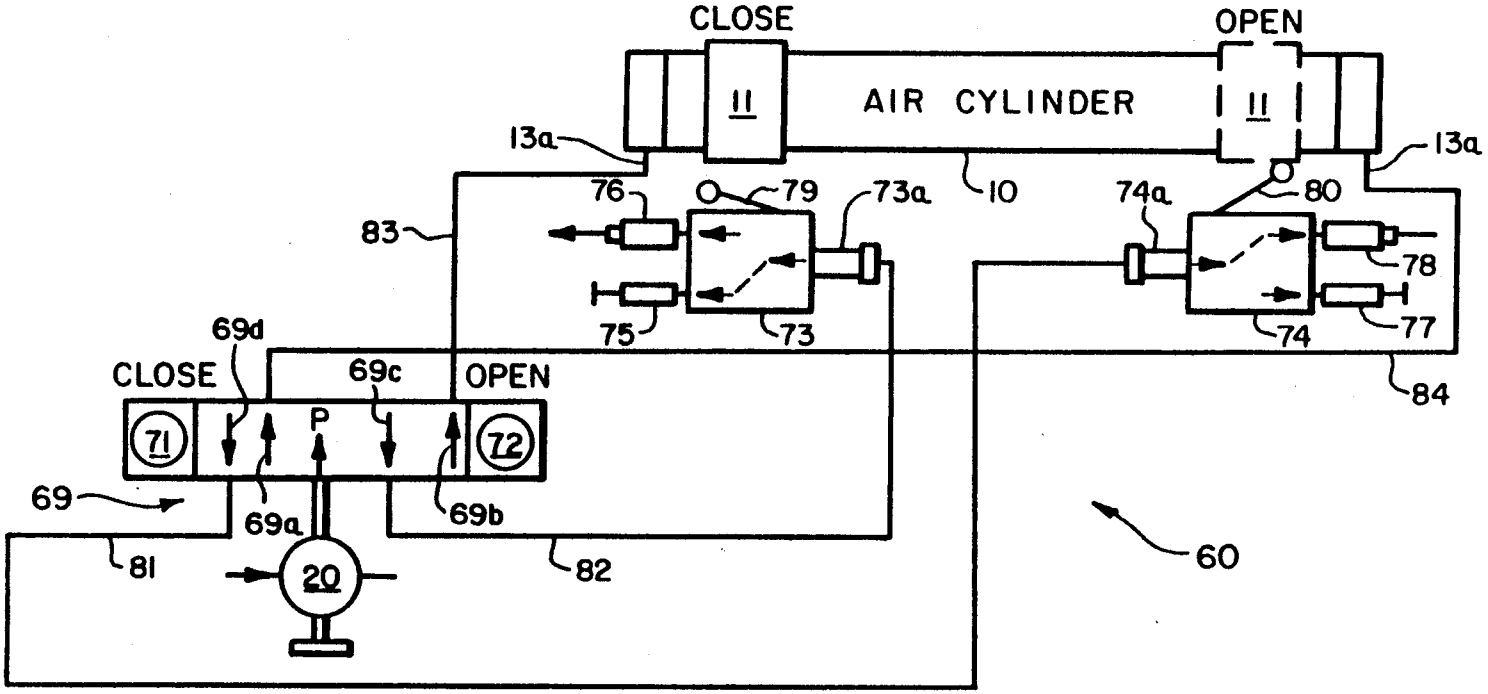
FIG. 13 is a simplified pneumatic circuit typically used to operate the door operator of the invention.

Pneumatic operation of the door operator invention is typically accomplished through the simplified circuit of FIG. 13. As those skilled in the pneumatic arts will readily understand that many other variations and adaptations of the disclosed pneumatic circuitry can be utilized, applicant's disclosure is non-limiting, and only included as an adjunct to the invention disclosed herein. Turning now to FIG. 13, supply air is introduced to a regulator 70 supplying regulated pressurized air to a two-position solenoid operated pneumatic valve 69 having open and closed solenoids 72 and 71 respectively. Air from the two position valves 69 is supplied for either opening or closing to the rodless cylinder 10 via inlet ports 13*a* and conduits 83 and 84. The rodless cylinder 10 is schematically shown to have an external piston 11 shown in FIG. 13 in the closed position with a phantom location indicating an open position of the external piston.

Figure 14:
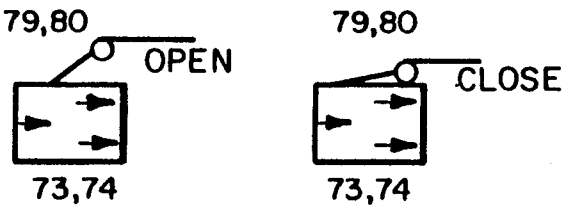
FIG. 14 is a schematic representation of fluid flow through pneumatic limit switches 73, and 74 actuated and nonactuated positions of actuating levers 79 and 80.

At either end of the cylinder 10 and arranged for contact with the external cylinder 11 in either open or closed position are pneumatic limit switches 74 and 73 respectively. Pneumatic limit switches 73 and 74 further equipped with exhaust silencers 76 and 78, and adjustable cushion vent or air throttling ports 75 and 77 respectively. As shown in FIG. 14, the pneumatic limit switches are arranged to transfer a pneumatic path from each inlet 73*a* and 74*a* to one or two exit ports depending on the position of operating levers 79 and 80 as shown.

In operation, with particular reference to FIG. 13, wherein the external cylinder is shown in a closed position, the preceding or closing operation was accomplished by energizing solenoid 71 whereupon the two-position pneumatic switch 69 controlled pressure operating air to enter the right hand end of the cylinder 10 via inlet port 13*a*, conduit 84, and valve exit port 69*a*. Also, in the movement of the air cylinder internal piston 10*a* from open to closed followed by the external piston 11, operating exit air was vented via left hand exit port 13*a*, conduit 83, and solenoid cylinder exit port 69*c*. Vented air further passes through external piston pneumatic limit switch 73 via conduit 82 and adjustable cushion orifice 75.

For the reverse operation, i.e., motion of external cylinder 11 and internal cylinder 10*a* from closed to open, open solenoid 72 on energization, interconnects inlet pressure port P with solenoid valve of exit port 69*b* admitting air to the left hand and of cylinder 10 via conduit 83. Simultaneously, energization of the open solenoid 72 connects the right hand port 13*a* of cylinder 10 with the right hand pneumatic switch 74 via conduits 84, ports 69*a*, and 69*d*, and conduit 81. As shown right hand pneumatic switch 74 in its undepressed or unactuated position conducts exhaust air from conduit 81 through fitting 74*a* and air exit silencer 78.

The action of pneumatic limit switches 73 and 74 are such that prior to actuation by movement of external piston 11 of air cylinder 10, exit air is conducted or vented to the atmosphere via silencers 76 and 78. On motion of the external piston 11, such that the operating levers 79 or 80 are depressed, exit air passage is changed so that exhaust air exits via the adjustable or cushion orifice 75 or 77 respectively. For locations of external piston 11, between open and closed positions, i.e., when both operating levers of switches 73 and 74 are in the upright or unactuated position, the porting arrangement of open/close solenoid 69 insures the proper operating air inlet and exhaust air outlet circuitry.

Figure 11:
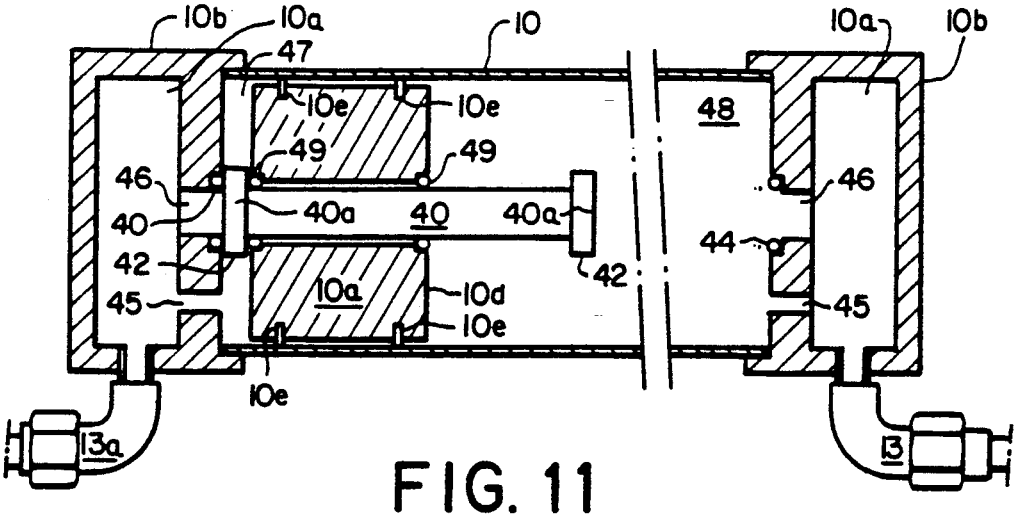
FIG. 11 is an additional sectional view of the rodless cylinder of FIG. 10, showing the internal piston and piston cushioning rod in a piston position at the cylinder left hand end.
Figure 12:
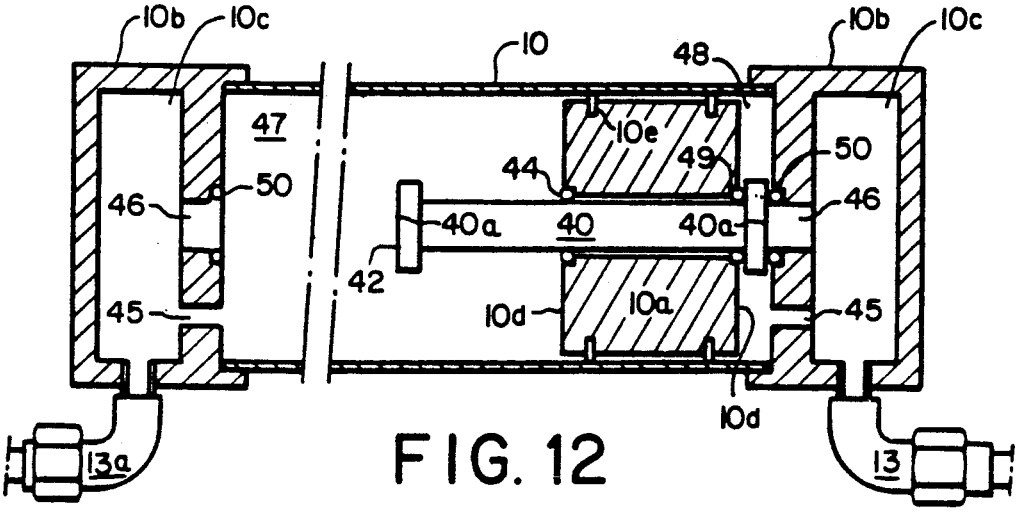
FIG. 12 is a further sectional view of the rodless cylinder of FIG. 10, showing the internal piston and piston cushioning rod in a piston cushioning configuration at the cylinder right hand end.

Applicant submits that the above pneumatic circuit is only typical may or may not be used in conjunction with a feature of the invention disclosed in FIGS. 10, 11, and 12 herein, and is included only to provide a complete operating description of one embodiment of the invention disclosed.

Operation of the reaction lock or the invention as disclosed is best understood with particular reference to FIGS. 5, 6, 7, 8, 9, and 9*a*. In operation, beginning with the doors in a closed position as shown in FIG. 1, with no air pressure in either side of the cylinder (10). Under FIG. 5 and the door latch and hook assembly would be engaged as indicated in FIG. 8*c*. It should be noted that at all times when pressure is absent from either side of cylinder (10), the reaction spring (20*a*) will position the cylinder lost motion retaining pin (19) at the left hand edge of the slot (17*a*) with pin (19*a*) positioned in slot (18*a*) as shown in FIG. 2. The latch assembly (31) and hook (30) will be in the engaged position as shown in FIG. 8*c*, thus preventing movement of the belt (16) thereby locking both doors (2) and (3) in position shown in FIG. 1.

Figures 6, 7:
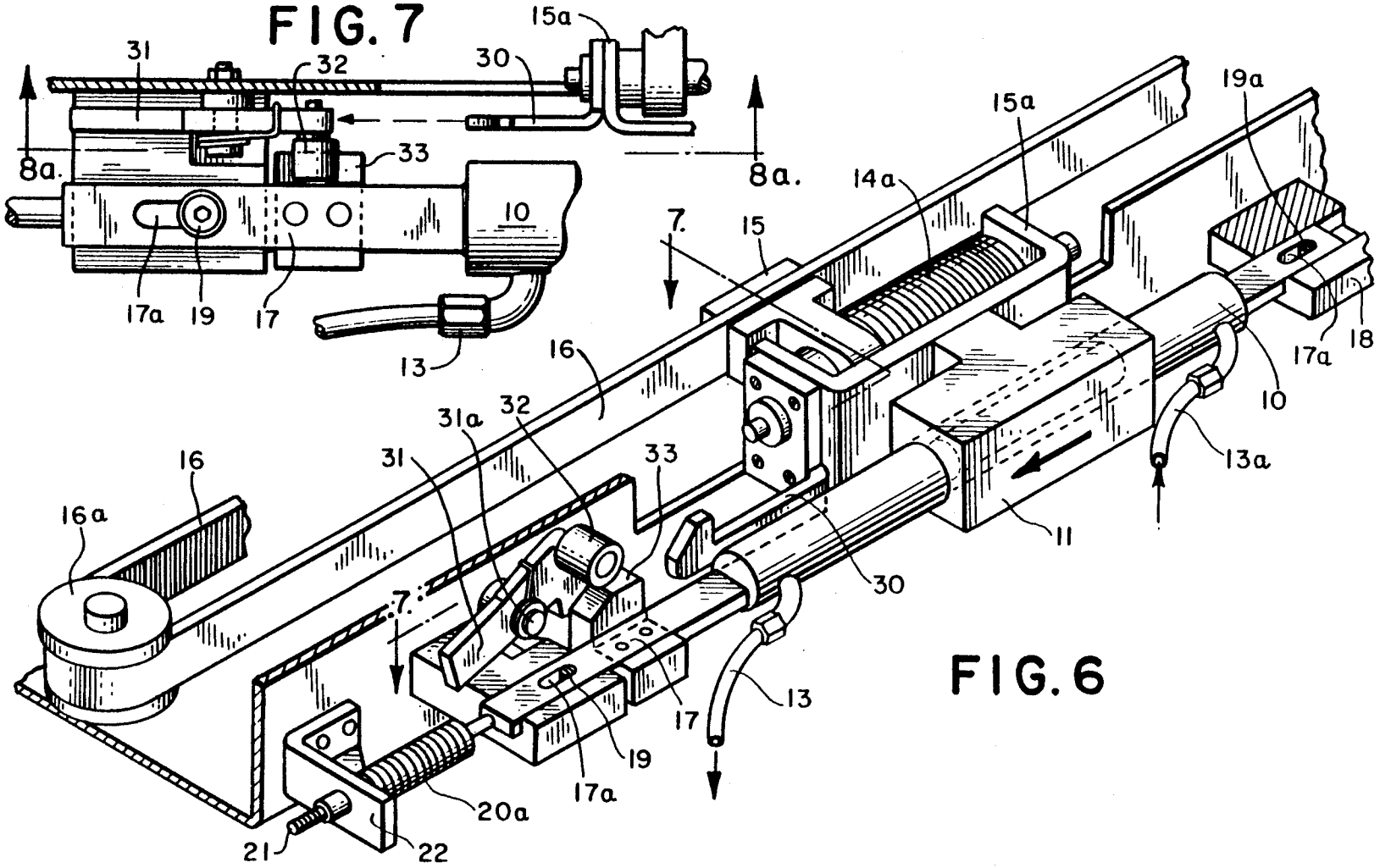
FIG. 6 is an isometric view of the mechanical lock, lost motion link of the operating cylinder, and location of the external piston attachment to the door operating cog belt, with lock components in positions immediately prior to a locked condition.
FIG. 7 is a detailed partial view of the actuating portion of the lost motion lock of the invention along Section 7—7 lines of FIG. 6, showing lock components.
Figure 8A:
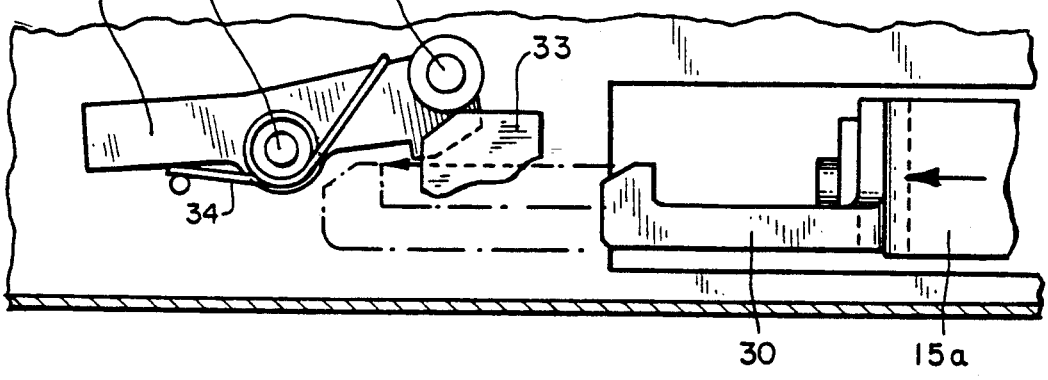
FIG. 8*a*, 8*b* and 8*c* are partial plan views of the latch lock and actuating ramp portions of the positive mechanical lock of the invention with portions of the operator construction removed for clarity. In sequence, action of the lock in moving from unlatched to latched positions are shown.
Figure 8B:
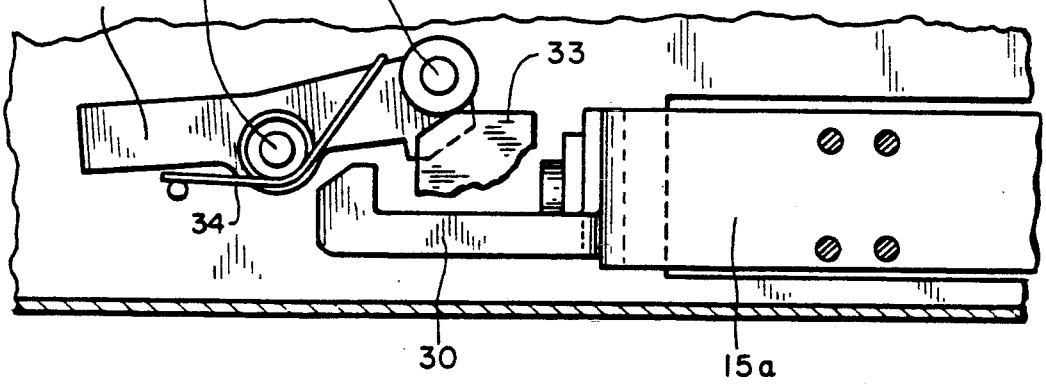
Figure 8C:
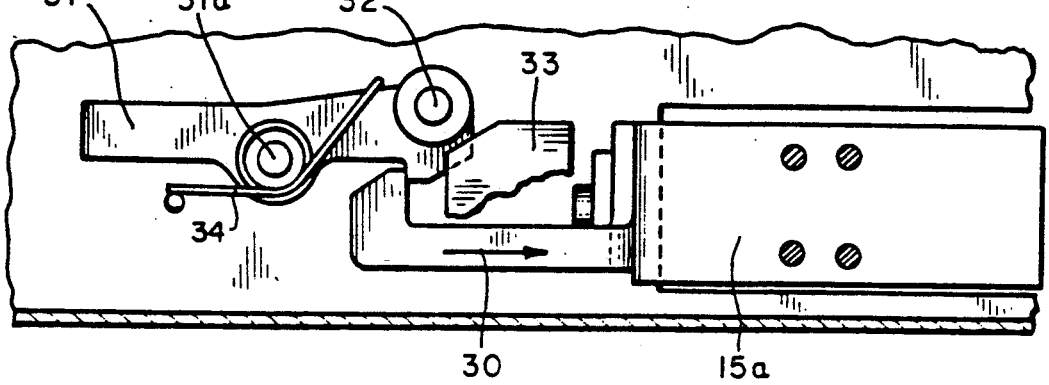
Figure 9:
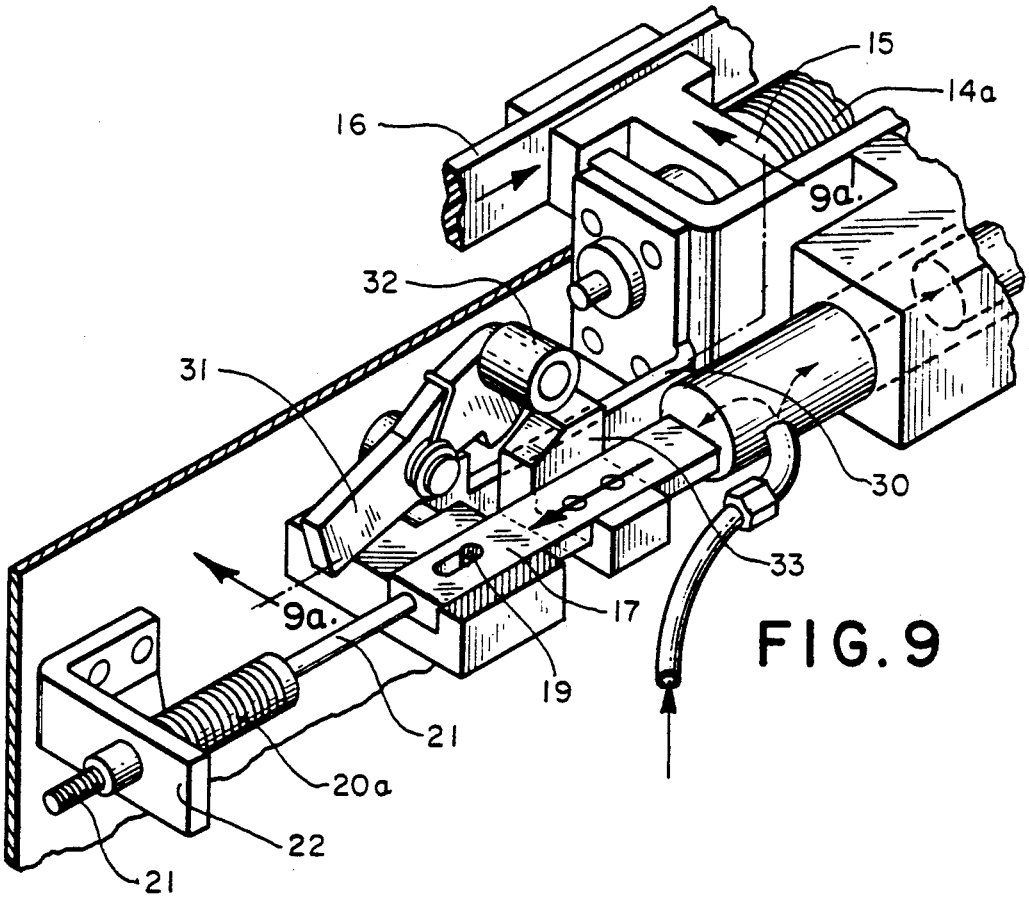
FIG. 9 is a further perspective view of the mechanical lock of the invention as the actuating piston moves in the direction of locking with doors closed.
Figure 9A:
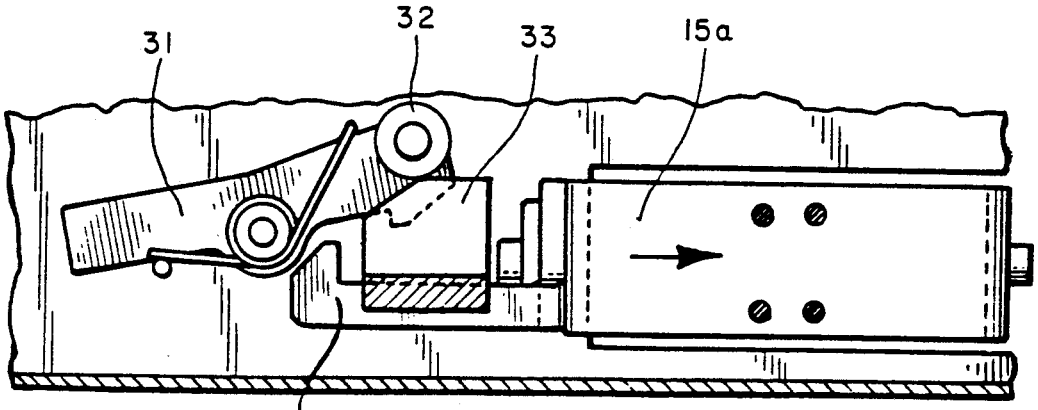
FIG. 9*a* is a detailed view of a portion of FIG. 9 along the lines of Section 9*a*—9*a*, showing the action of the novel reaction lock of the invention, and particularly showing the latch and lock just before engaging. Also shown is the opposite relative motion between the latch hook and actuating or external drive piston.

On admission of air to the left hand end of cylinder (10) through air inlet (13), forces generated due to the difference in pressure on internal piston (10*a*) (Reference FIG. 5), will produce an equal and opposite force on the cylinder (10), moving the cylinder end so as to position the pin (19) at the right hand end of slot (17*a*). With reference to FIG. 6, left hand movement of the cylinder (10), external piston (11) and right-hand cylinder end (23) moves the door unlock wedge (33) to the left (Reference FIG. 6), thereby contacting door latch roller (32), rotating the latch assembly (31) around its pin support (31*a*) against latching force exerted by latch hold down spring (34) thus placing the latch elements (31), (32), (33) and (30) as shown in FIGS. 9 and 9*a*. Reaction movement of the cylinder (10) has therefore unlocked the latching members of the lock assemblies.

On contact of the lost motion pin (19) with the right hand edge of the slot (17*a*) along with unlocking the latch members, external cylinder (11) moves the door force bracket belt adapter (15) in the right hand direction (Reference FIGS. 5, and 3*b*). Movement of the belt (16) around pulleys (16*a*) and (16*b*) moves door operating brackets (23) and (24) so as to move door (2) in a left hand direction and door (3) in the right hand direction as shown in FIGS. 3*a* and 3*b*.

Force is applied to the belt (16) by external piston (11) through the push back and force limiting assembly (12) (Reference FIG. 2). As the door force assembly bracket (15*a*) moves to the right, spring (14*a*) is compressed as the door force belt adapter (15) moves leftward along the door force adapter shaft (14) thereby compressing spring (14*a*) to some extent. The spring rate of (14*a*) is chosen so as to allow a predetermined amount of relative motion between the bracket (15*a*) and belt (16) thereby allowing a predetermined amount of relative motion of the doors (2) and (3) through actuating brackets (23) and (24).

Movement of the doors (2) and (3) in the opening direction proceeds until the internal piston (10*a*) approaches the left hand end of the cylinder (10) (Reference FIGS. 13, 14 and the above description of pneumatic operating system 60).

Operation of an alternate embodiment of the invention disclosed herein is best understood by reference to FIGS. 10, 11, and 12. As this aspect of the disclosed invention involves only the internal cylinder and associated operating air ports, FIGS. 10, 11 and 12 for the sake of clarity show only the operating components involved.

With particular reference to FIG. 10, there is shown the rodless cylinder 10 having an internal pressure sealed piston 10*a* dividing the cylinder into pressure sealed volumes 47 and 48. Internal of, and coaxial with the an internal piston cushion rod 40, having somewhat enlarged head 42 at either end, and an intermediate shaft 41, the containment of piston cushion rod 41 internal of the pressure responsive piston 10*a* is such that relative reciprocal motion between piston 10*a* and the cushion rod 40 is possible. Travel of rod 40 internal of the piston 10*a* is limited by the heads 42 at either end such that the maximum extension of the rod 40 and shaft 41 termed a rod ceiling length is of a predetermined value. The significance of this rod ceiling length will be discussed below. In order to insure the pressure integrity of chambers 47 and 48, sliding pressure seals 49 are interposed between the cushion rod shaft 41 and the pressure responsive position 10*a*.

The piston ends 10*b* contain internal chambers 10*c* in fluid communication with operating fluid ports 13*a*. Each internal chamber has at one end a main cylinder vent port 46 and a reduced diameter cylinder cushion port 45. Each main cylinder vent 46 has on its internal surface an annular seal 50. Rod ends 42 in cooperation with seals 50 restrict cylinder air exit for predetermined positions of a cushion rod 40 when cushion rod ends 42 but the seals 50 as shown in FIGS. 11 and 12.

In operation, during the movement of internal piston 10*a* from either end to the other, i.e., from opened to closed or closed to open positions of the operated door, relative positions of piston 10*a* and piston cushion rod 40 are such that the effective pressure sensing areas are the sum of a cross section area of piston cushion rod shaft 41 and the annular area of piston 10*a*. These are shown on FIG. 10 as 10*d*. Similarly the effective pressure sensing areas of the piston cushion rod 40 are shown on FIG. 10 as 40*a*.

During piston travel, from either end to the other, when the extended portion of piston cushion rod shaft 41 is equal to or less than the distance between that face of piston 10*a*, and the adjacent cylinder end, end 42 of the cushion rod 40 abuts the main vent orifice seal 50 thereby restricting exhaust air flow from the chamber 47 to flow through cushion in port 45. Contact of the cushion rod end 42 and seal 50 effectively removes the effective pressure sensing area of rod 41 i.e., 40*a*, from the force producing sum of the opposite side of piston 10*a*, that is the effective pressure sensing area of piston 10*a* becomes the difference between area 10*d* and 40*a*, thereby reducing the effective closing force on piston 10*a* and conditioning travel of 10*a* and its associated movement of external piston 11 and ultimately the enclosure speeds and force of operated doors 2 and 3. Applicant submits that although the cushioning effect of the differential area piston comprising internal piston 10*a* and cushion rod 40 can be utilized in both opening and closing modes of the doors controlled, any combination of the disclosed differential area piston and its conditioning of door movement and other pneumatic control systems will be seen by those skilled in the arts. Those skilled in the arts will also readily see that the reverse operation, i.e., piston travel from left to right in FIG. 10 will proceed in an identical manner.

An additional alternate embodiment of the invention is shown in FIGS. 15, 16, 17 and 18. Although the reaction lock disclosed above, has operated successfully, and provides adequate locking through immobilizing the drive belt, there are certain applications where it is necessary to provide a direct mechanical lock between the car body and door panel, making the locking function entirely independent of the door operator drive. This approach to door panel locking is described in the abovementioned FIGS. 15 through 18.

Figure 15:
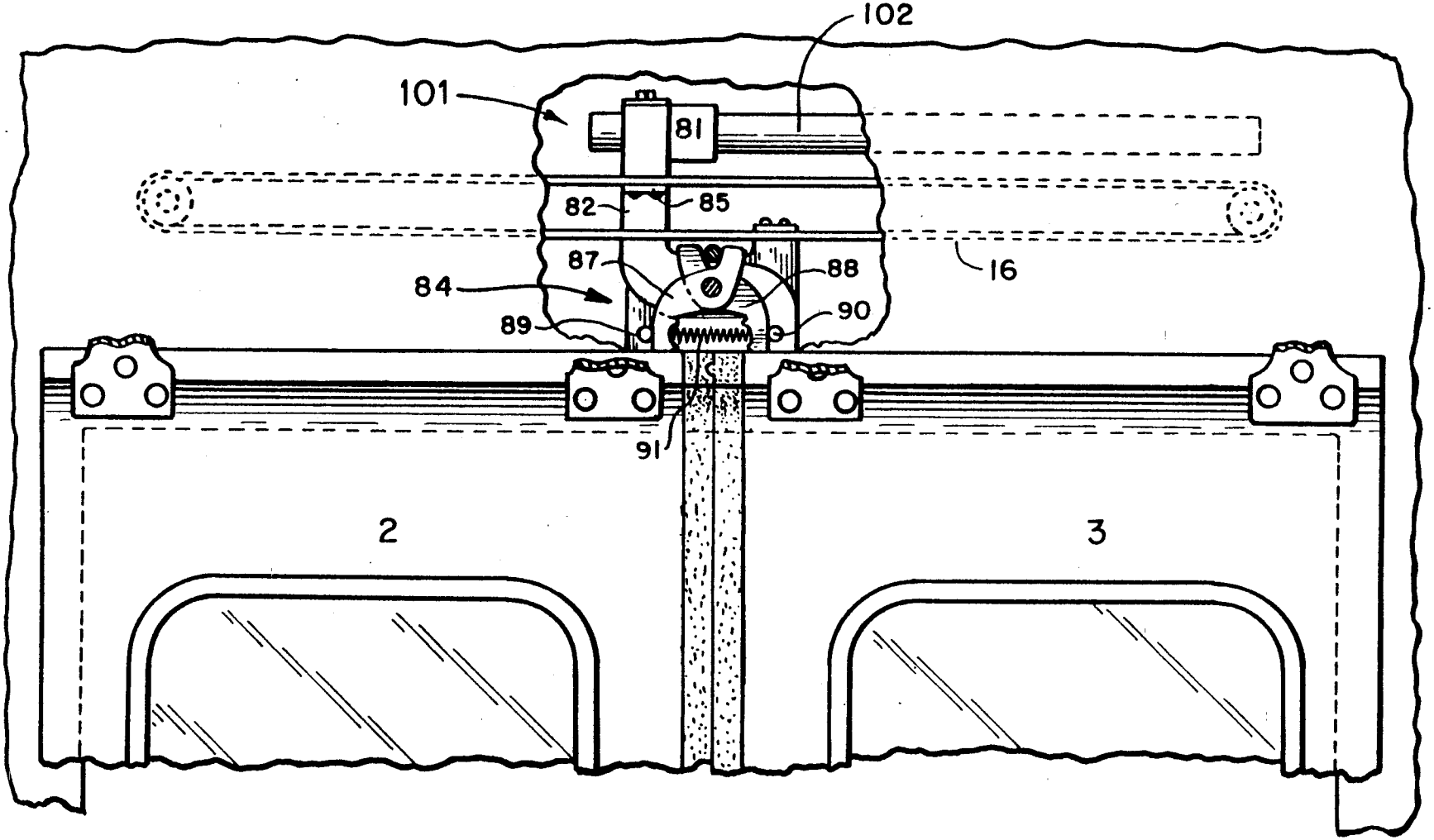
FIG. 15 is an external view of the invention disclosed as applied to by parting doors. In particular, the tear away portion of this figure shows the positive lock assembly in a door closed and locked position.

In reference to FIG. 15, the disclosed alternate embodiment includes a modified external piston/cylinder assembly, 101, also including a modified external piston 81. The piston 81 is operatively attached to the panel drive belt 16, for moving bi-parting door panels 2 and 3 from opened to closed positions. Piston 81 drives door panel 3 and the internal side of drive belt 16 through drive/lock bracket 82 (reference FIG. 17). Opposite bi-parting door panel 2 is operatively attached to the outer side of belt 16 through drive/lock bracket 83. This construction provides for opposing motion of panels 2 and 3 corresponding to movement of the external piston 81 along in pneumatic cylinder 102, as earlier described.

Figure 16:
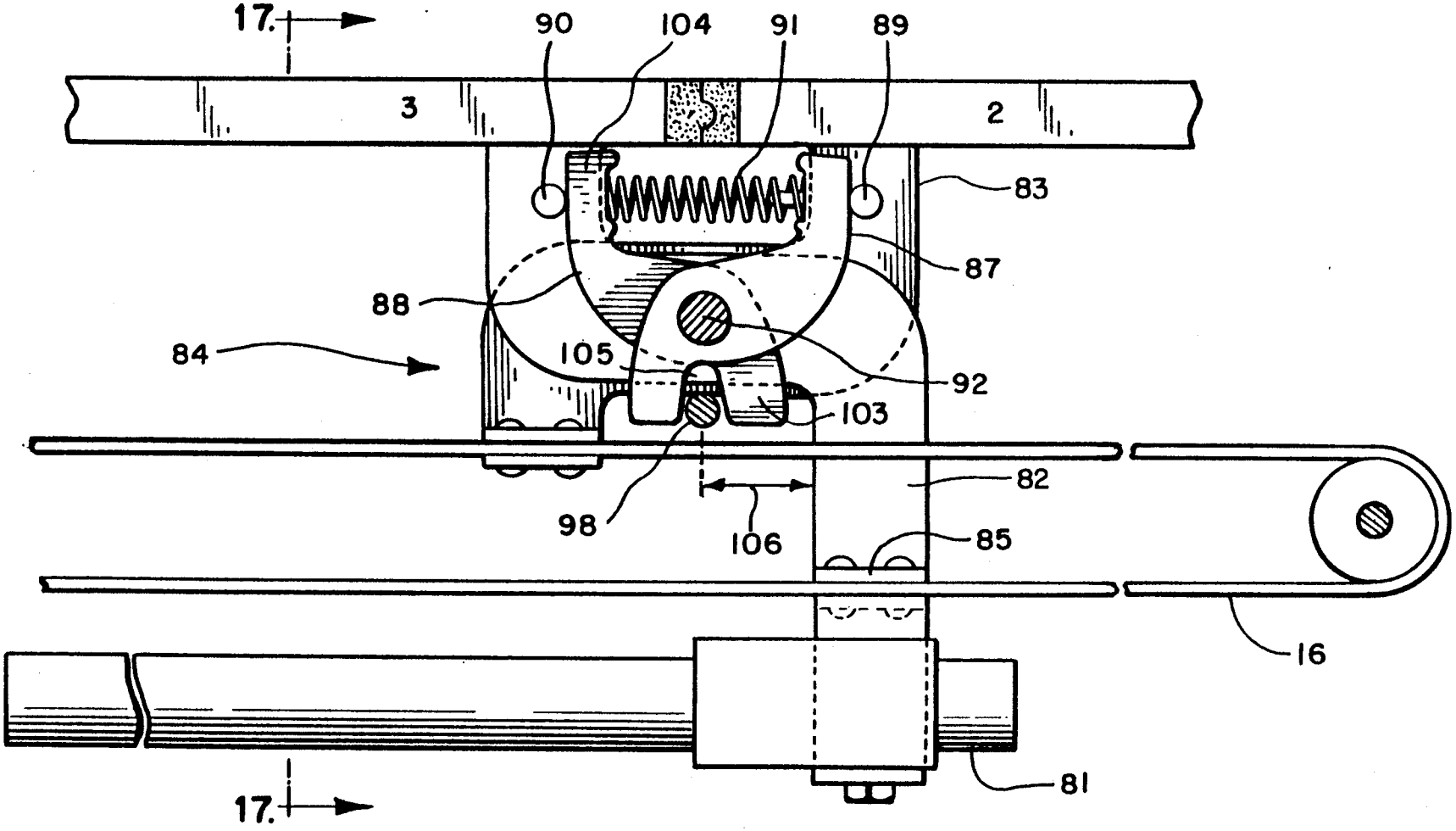
FIG. 16 is an additional partial view of the additional embodiment of the invention disclosed along the lines 16—16 of FIG. 17, in particular showing box/drive arms and lock arms with the locking pin in the door closed and locked position.
Figure 17:
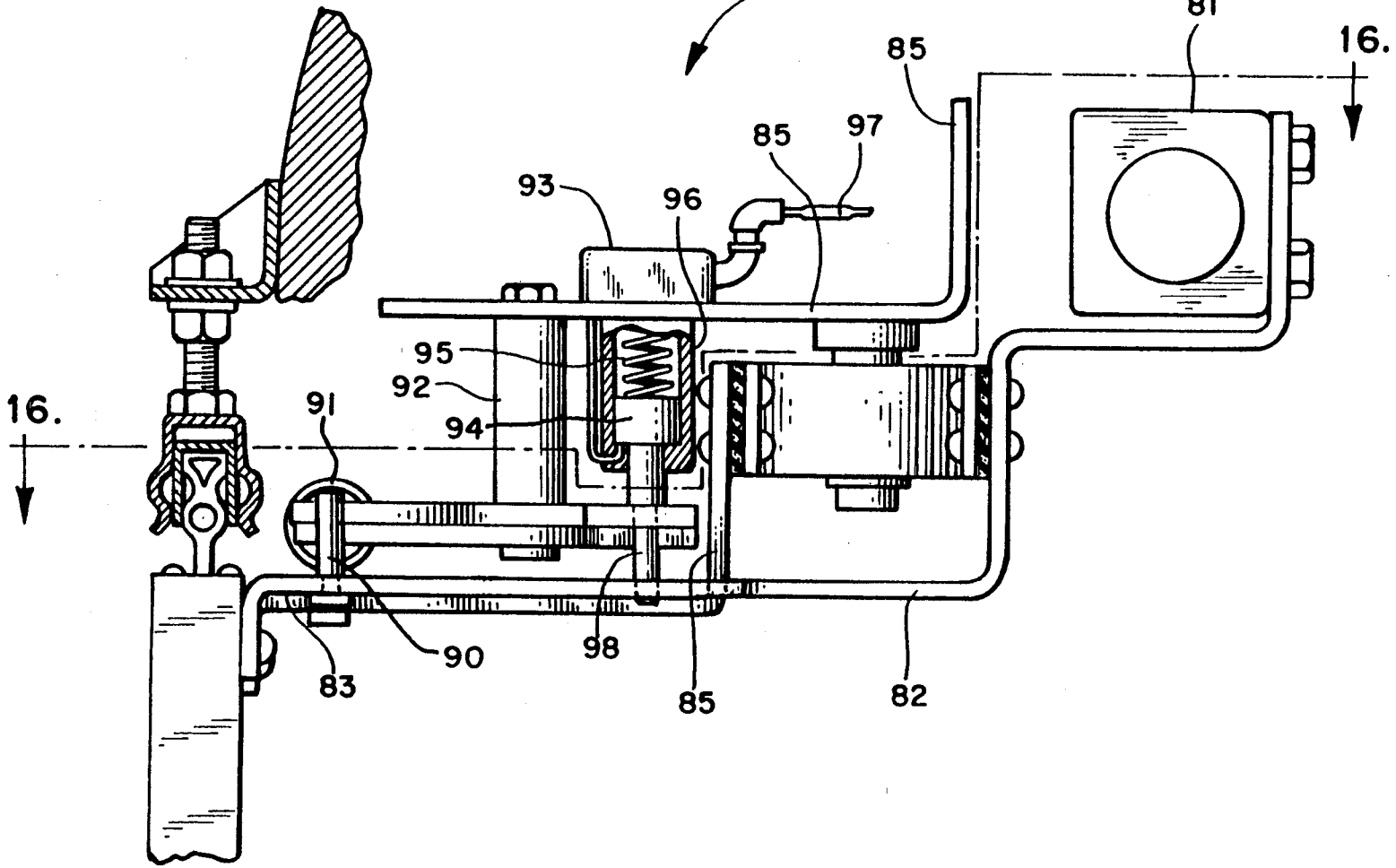
FIG. 17 is a section of the alternate embodiment of the invention along the lines 17—17 of FIG. 16 in particular showing the operating door, drive/lock arms, lock arms, and the external drive piston 81 and drive belt 16.

Direct panel locking of bi-parting door panels 2 and 3 is provided by the panel lock assembly 84 (Reference FIGS. 16 and 17). The panel lock assembly 84 includes panel lock arms 87 and 88 pivotally mounted on pin 92 mounted on and extending downward from mounting bracket 85. Lock arms 87 and 88 as mounted form a scissors like assembly having inner jaws 103 located adjacent to the outer surface of drive belt 16, and outer jaws 104 located adjacent to the inner edges of by parting door panels 2 and 3. The compression spring 91, retained between outer jaws 104 of the pivotally mounted lock arms, positions inner and outer jaws 103 and 104 respectively so that in a fully extended position (with pins 89 and 90 absent) inner jaws 103 are in vertical alignment, that is closing inner jaw space 105 for a door open position (not shown).

Mounted on and extending upward from the portion of drive/lock arms 82 and 83 are stop pins 90 and 89. For the door closed position shown in FIG. 16, stop pins 89 and 90 contact the outer edges of external lock arm jaws 104 positioning inner jaws 103 of lock arms 87 and 88 so as to provide vertical clearance through space 105, for a lock pin 98 projecting from the lock cylinder 96 of lock assembly 84 (Reference FIG. 17).

The locking assembly 84 also includes a panel lock actuator 93 mounted on bracket 85 consisting of a pneumatic cylinder 96, operating piston 94, and lock pin 98 projecting downward of the cylinder lower end. Internal of the lock cylinder 96 is a fluid actuated piston 94 force biased downward by internal compression spring 95. Pressurized fluid entering the cylinder inlet 97 located in the cylinder mounting head 93 forces the piston 94 upward against the bias force of spring 95, in order to raise the lock pin 98.

Figure 18:
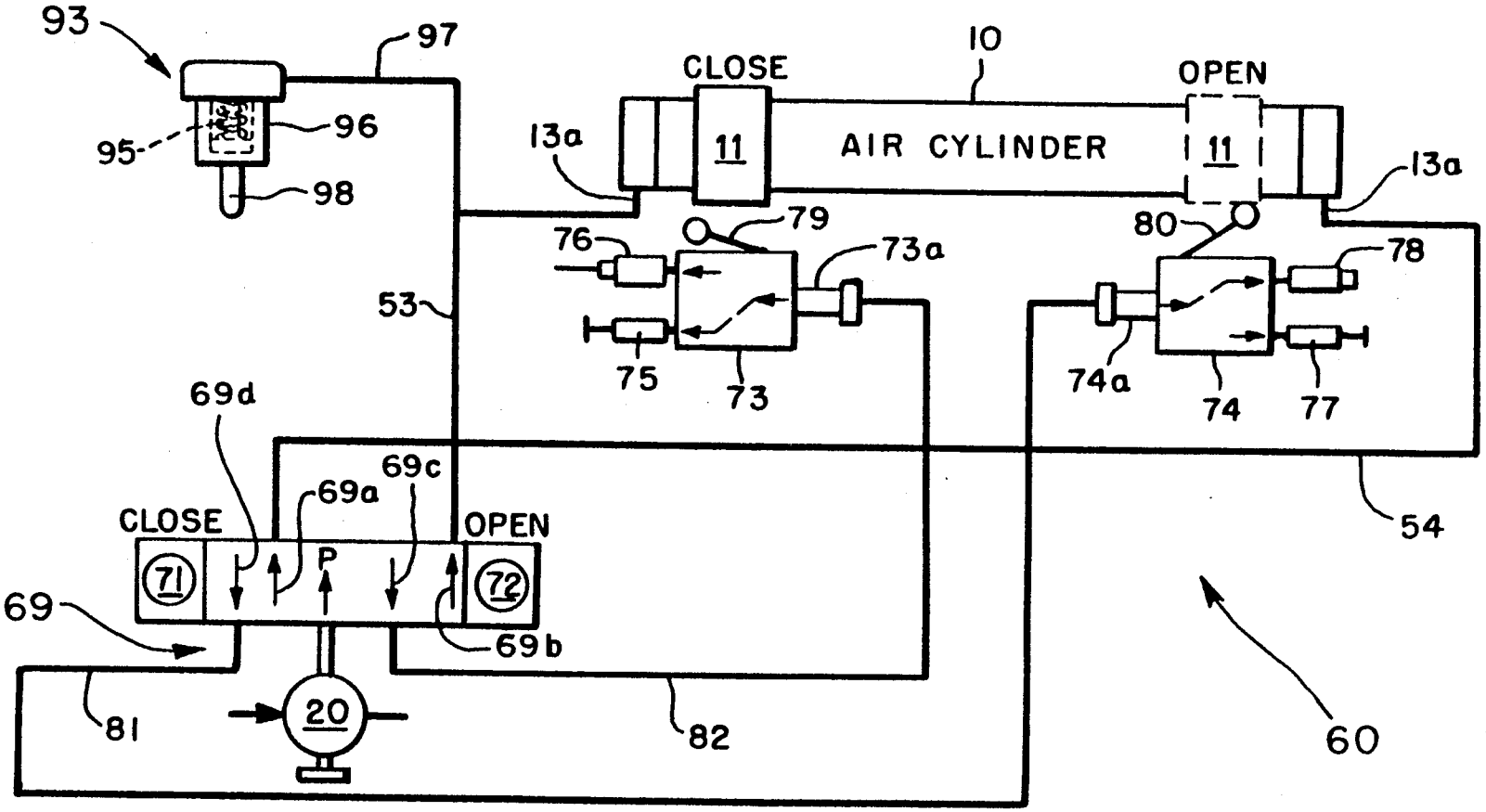
FIG. 18 is a simplified pneumatic circuit particularly showing pneumatic circuitry utilized with the alternate embodiment utilizing a positive door panel lock.

In reference to FIG. 18, for a door opening operation, pressurized fluid to raise the lock pin 98 is admitted to the cylinder 96 via conduits 53 and 97. Operation of lock cylinder 96 will be further discussed below in connection with overall operation of the direct panel locking system.

In door operation assuming by parting doors 2 and 3 are closely approaching a door closed position, pins 89 and 90 contact the outer surfaces of external jaws 104 of lock arms 87, at this point held in an extended position by compression spring 91, thereby eliminating space 105, and preventing the entry of lock pin 98. As the doors reach a closed position reference FIGS. 15, 16 and 17, pins 89 and 90 compress spring 91 rotating lock arms 87 and 88 providing a space 105 between the inner jaws of lock arms 104. Compression spring 95 internal of the lock cylinder 96 forces pin 99 into space 105. Lock pin 98 extends downward beyond the extensions of drive/lock arms 82 and 83 inward of the pivot 92. Movement of doors 2 and 3 beyond distance 106 is prevented by contact of pin 98 with the edges of lock arms 87 inner jaws (Ref. FIG. 16). In this position pin 98 effectively locks panels 2 and 3.

Limited motion 106 of door panels 2 and 3 in the opening direction is provided by abutment of the pin 98 with inner surfaces of door drive/lock brackets 82 and 83. This feature known to those skilled in the power door arts is known as push back and allows removal of articles of clothing, or other objects associated with passenger movement through automatic power operated doors.

With particular reference to FIG. 18, with the doors in a closed condition as shown, operation from closed to open is accomplished through admission of pressurized fluid via actuation of the open solenoid 72. The valve assembly 69 in an opening operation admits pressurized fluid via conduits 53 and 97 to end 13*a* of cylinder 11, and the underside of piston 94 of the lock cylinder 96. As the volume of cylinder 96 is small in comparison to the volume of drive cylinder 10, admission of fluid to the cylinder 96 will raise lock pin 98, thereby extracting it from the lock space 105 in advance of movement from closed to open of the external piston 11 of drive cylinder 10. This arrangement minimizes any sequencing operations in going from door lock to unlock or normal open/close operation of doors 2 and 3.

Thus it is apparent that there has been provided in accordance with invention, a pneumatic power door operator incorporating a pneumatically operated positive mechanical lock that fully satisfies the objects aims and advantages set forth above. While the power operator door disclosed has been described in conjunction with a specific embodiment thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

Therefore we claim:

1. In a power door operator utilizing a rodless cylinder having an internal fluid sealed piston and a magnetically coupled external piston, internal piston motion in said cylinder provided by admission of a pressurized fluid to said cylinder on either side of said piston in order to open and close bi-parting passenger doors over an opening in a vehicle side wall, the improvement comprising:

first and second coplanar doors mounted on said car for opposing motion in covering and uncovering an opening in said side wall; an endless belt and piston attachment operatively attaching said belt attached to said external piston, said belt on a mounting on said vehicle, said belt mounting arranging said belt with first and second oppositely moving belt surfaces positioned and moving essentially parallel to movement of said doors, said belt moved in conjunction with said external piston;

a first drive arm attached to said first belt surface, said first arm connected to said first door and having a first inner edge intermediate said door and second belt surface;

a second drive arm extending from and attached to said second belt surface and connected to said second door, said second drive arm also having an inner edge, one of said edges oppositely disposed relative to the other said edge when said doors are in said closed position;

stop pins projecting from said drive arms;

a door movement space defined between said drive arm inner edges when said doors are in a door closed position; and, a panel lock assembly for restricting door panel movement when said doors are in said closed position comprising:

a mounting bracket on and extending from said vehicle side wall, said bracket aligned with said door movement space in the door closed position;

a pivot pin on and extending from said bracket;

first and second panel lock arms mounted on said pin for pivotal scissor-like motion around said pin;

first and second inner and outer jaws on opposite ends of said lock arms, said inner and outer arms intermediate said belt and said passenger doors;

means intermediate said outer jaws for biasing said lock arm outer jaws outwardly and inner jaws inwardly;

first and second lock arm positions corresponding to said door closed position and a door open position, said drive arm pins moving said outer lock arms inwardly from said second position to said first position on door motion from said open position to said closed position and from said first position to said second position on door opening;

a lock aperture, defined by said lock arm inner jaws when said lock arms are in said first position, said aperture closed by said lock arms in said second position;

means on said mounting bracket operable by said cylinder for projecting a force biased lock pin into said lock aperture and said door movement space; wherein when said doors are in said closed position said lock pin occupies said door movement space and said lock aperture thereby limiting door movement from a fully closed position.

2. In combination, a power door operator utilizing a rodless cylinder including an internal fluid operated piston and a magnetically coupled external piston driving an endless belt for moving a pair of bi-parting door panels from open to closed positions over an opening in a side wall of a transit vehicle, and a panel lock comprising;

means mounting said door panels for reciprocating motion between said open and closed positions along said car side wall;

means mounting an endless belt for producing opposing motion along opposing portions of said belt, said portions parallel to and spaced from said door panels and side wall;

a first door drive arm operatively attached to said external piston and a first portion of said belt, said arm extending from said belt and attached to one of said door panels;

a first edge on said first arm, said edge essentially perpendicular to and disposed intermediate said panel and belt;

a second door drive arm extending from a second and opposing portion of said belt, said arm attached to the other of said panels;

a second edge on said second drive arm extending perpendicular to said belt and facing said first drive arm edge when said doors are in said closed position;

a door movement space defined between said first and second arm edges when said door panels are in said closed position;

a bracket on said car side wall, said bracket having an end intermediate said door and said belt;

lock means for locking said doors, said lock means mounted on said bracket at said end, and partially operable by said door drive arms comprising:

first and second lock arms with stop pins, said stop pins in alignment with said door drive arms for engagement during door motion to said door closed position;

a lock aperture defined between said lock arms, when said door is in a door closed position, said lock aperture and door movement space disposed in vertical coincidence;

means on said bracket for projecting a biased latch member into said lock aperture and door movement space when said door panels are in said closed position, said latch member cooperating with said drive arms to prevent door movement from a closed position to an open position;

means for selectively retracting said latch member;

whereby door motion from open to closed position engages said latch means and said lock arms, limiting drive arm movement across said door movement space, thereby preventing door movement from said closed position to said open position and selective retraction of said latch and whereby member allows said doors to move to said open position.

3. The combination of claim 2 wherein said member projecting means is a spring biased fluid operated cylinder and said member is a cylindrical pin.

* * * * *

UNITED STATES PATENT AND TRADEMARK OFFICE

CERTIFICATE OF CORRECTION

PATENT NO. : 5,148,631

DATED : September 22, 1992

INVENTOR(S) : Robert G. Bayard, Anthony J. Walsh, Roger J. Weseloh

It is certified that error appears in the above-identified patent and that said Letters Patent is hereby corrected as shown below:

In Claim 2, Column 14, line 16, after "and" add --whereby--.

In Claim 2, Column 14, line 17, delete "and whereby".

Signed and Sealed this

Twenty-eighth Day of September, 1993

Bruce Lehman

*Attest:*

BRUCE LEHMAN

*Attesting Officer*

*Commissioner of Patents and Trademarks*